US005226360A

United States Patent [19]

Kramka

[11] Patent Number: 5,226,360

[45] Date of Patent: Jul. 13, 1993

[54] BUNDLING DEVICE

[76] Inventor: Thomas R. Kramka, 37 W. 150 Olwin Ave., Elgin, Ill. 60123

[21] Appl. No.: 904,999

[22] Filed: Jun. 26, 1992

[51] Int. Cl.[5] ..... B30B 12/00

[52] U.S. Cl. ..... 100/219; 24/67.1; 100/274; 402/63

[58] Field of Search ..... 100/1, 219, 274-277; 24/16 PB, 17 AP, 67 R, 67.1; 402/17, 63, 68, 8, 59, 62, 64

[56] References Cited

U.S. PATENT DOCUMENTS

| | | | |
|---|---|---|---|
| 417,253 | 12/1889 | Lalor | 24/67.1 |
| 877,782 | 1/1908 | Kriete | 24/67.1 |
| 1,378,753 | 5/1921 | Zwilling | 24/67.1 |
| 2,348,430 | 5/1944 | Wall | 402/63 X |
| 2,399,857 | 5/1946 | Connors | 100/219 |
| 2,779,987 | 2/1957 | Jordan | 402/63 X |
| 3,970,331 | 7/1976 | Giulie | 402/63 X |
| 4,305,675 | 12/1981 | Jacinto | 402/63 X |
| 4,606,666 | 8/1986 | Patton | 402/62 |
| 4,730,972 | 3/1988 | Sun et al. | 402/62 X |

*Primary Examiner*—Stephen F. Gerrity
*Attorney, Agent, or Firm*—Douglas B. White

[57] ABSTRACT

The bundling device of the present invention employs a molded plastic strap formed to present three sides, with the ends of the projecting sides having ridges for engaging a clamp member. Strap engaging channels are provided at each extremity of the clamp member and internally carry pawl members to ratchet against the strap ridges.

2 Claims, 2 Drawing Sheets

BUNDLING DEVICE

BACKGROUND OF THE INVENTION

1. Field of the Invention

This invention relates generally to devices employed to bundle stacks of paper currency.

2. Description of the Prior Art

Prior techniques for bundling stacks of paper currency have generally employed adhesively secured straps; but this has provided limited security.

SUMMARY OF THE INVENTION

Accordingly, it is the objective of the present invention to provide a clip device which increases security, and accommodates variable size stacks without breaking.

The plastic bundling device of the present invention employs a molded plastic strap formed to present three sides, with the ends of the projecting sides having ridges for engaging a clamp member. Strap engaging channels are provided at each extremity of the clamp member and internally carry pawl members to ratchet against the strap ridges.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
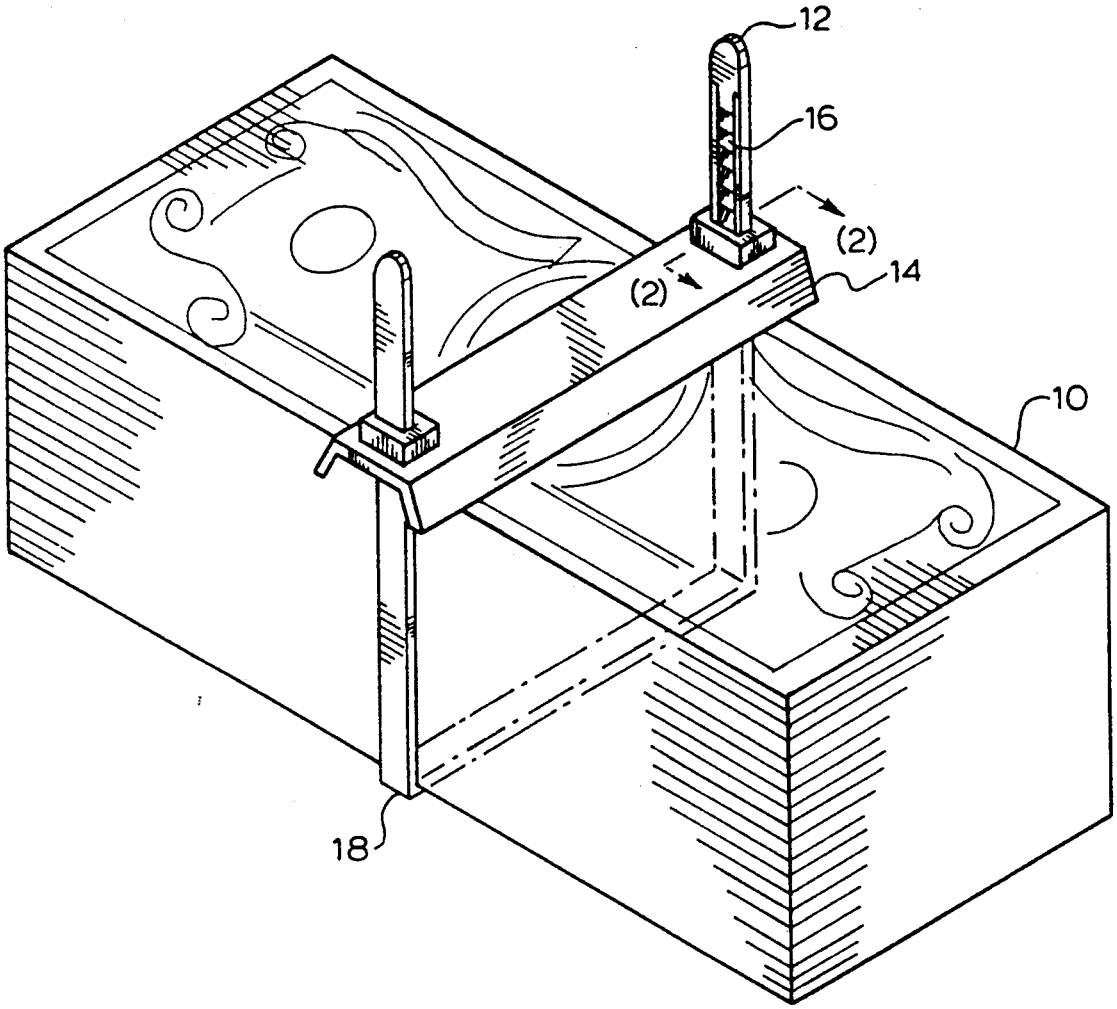
FIG. 1 is a perspective view of the plastic bundling device of the present invention shown securing a bundle of paper currency.

Turning first to FIG. 1 there is shown a stack 10 of paper currency secured by the plastic bundling device of the present invention. This bundling device employs a strap 12 and a clamp 14. The strap exhibits ratcheting ridges 16 defined therealong and particularly at each extremity. To facilitate the bend 18 at the corners, the strap may be manufactured with a flexible hinge in the form of a reduced thickness at that point.

Figure 2:
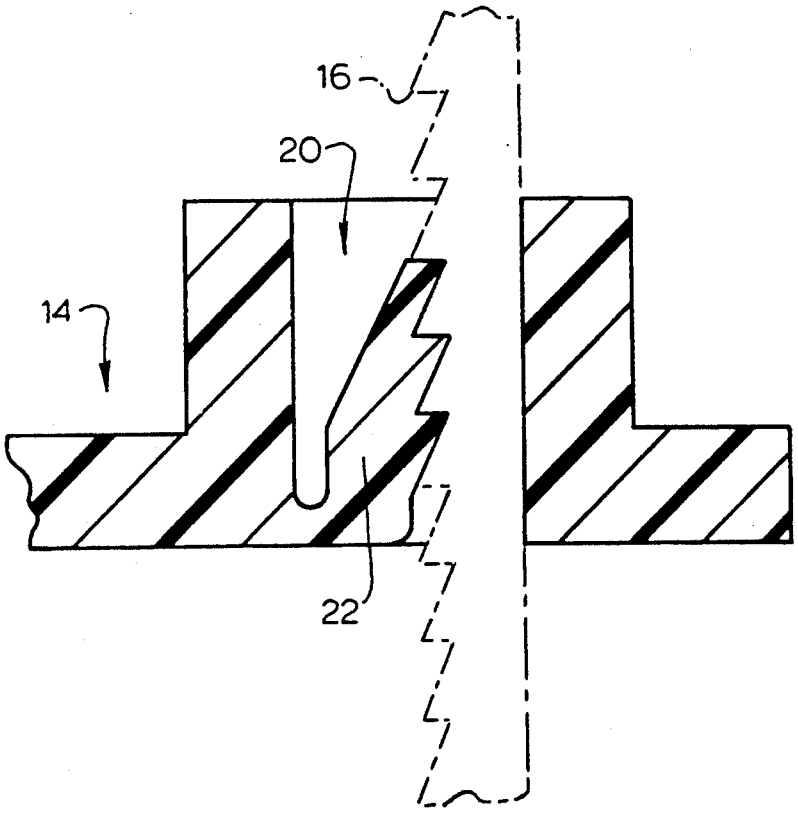
FIG. 2 is a cross sectional view of the attachment channel of the clamp.

As shown in FIG. 2, the clamp 14 is of generally "U" shaped cross section and employs channels 20 at each extremity to receive and secure the strap. This channel is formed as a raised annular region in the clamp and a pawl member 22 is hinged to the side of the channel to ratchet against the ridges 16 of the strap. In the preferred embodiment this pawl hinge is a flexible plastic attachment to the side of the channel.

To use this bundling device, the stack 10 is placed in the center of the strap 12 with the ends of the strap oriented vertically. The clamp is then positioned to receive the strap ends into its channels 20, allowing the pawls 22 to ratchet over the ridges 16. Pressing down on the clamp quickly and securely bundles the stack.

From the foregoing description, it will be apparent that modifications can be made to the apparatus and method for using same without departing from the teachings of the present invention. Accordingly, the scope of the invention is only to be limited as necessitated by the accompanying claims.

I claim:

1. A bundling device comprising:

a strap formed to present two projecting end portions and an intermediate side connected between and to said projecting end portions, wherein said projecting end portions exhibit a plurality of pawl engaging ridges thereon;

an elongated clamp member, of substantially "U" shaped cross section and having upper and lower surfaces defined thereon, said clamp member having strap engaging channels defined at each extremity thereof for receipt of said projecting end portions of said strap, wherein each channel comprises an annular region raised above said upper surface of said clamp member proximate the extremities thereof, and said channels further include pawl members positioned therein and attached to sides of said channels by a flexible plastic hinge to ratchet against said ridges of said projecting end portions of said strap.

2. The bundling device of claim 1, wherein said pawl members are positioned within said channels such that they are hinged proximate the lower surface of said clamp member and extend upwardly into said raised annular region.

* * * * *